US005901602A

United States Patent [19]

Donini et al.

[11] Patent Number: 5,901,602

[45] Date of Patent: May 11, 1999

[54] METHOD FOR THE LATERAL COMPACTING OF SLABS AND RELATIVE DEVICE

[75] Inventors: Estore Donini, Vimercate; Fausto Drigani, Zugliano-Pozzuolo Del Friuli, both of Italy

[73] Assignee: Danieli & C. Officine Meccaniche SpA, Buttrio, Italy

[21] Appl. No.: 08/824,356

[22] Filed: Mar. 25, 1997

[30] Foreign Application Priority Data

Mar. 25, 1996 [IT] Italy ..... UD96A0040

[51] Int. Cl.[6] ..... B21J 9/18; B21J 9/12

[52] U.S. Cl. ..... 72/453.03; 72/452.5; 72/206; 72/407; 72/416

[58] Field of Search ..... 72/407, 416, 206, 72/184, 452.5, 453.03

[56] References Cited

U.S. PATENT DOCUMENTS

| | | | |
|---|---|---|---|
| 4,760,728 | 8/1988 | Nikaido et al. | 72/407 |
| 4,852,383 | 8/1989 | Nikaido et al. | 72/407 |
| 4,930,207 | 6/1990 | Kojima et al. | 72/407 |
| 5,282,374 | 2/1994 | Kojima et al. | 72/407 |

FOREIGN PATENT DOCUMENTS

| | | |
|---|---|---|
| 224333 | 6/1987 | European Pat. Off. . |
| 0353788 | 2/1990 | European Pat. Off. . |
| 445898 | 9/1991 | European Pat. Off. . |
| 528051 | 2/1993 | European Pat. Off. . |

OTHER PUBLICATIONS

Patent Abstracts of Japan vol. 12, No. 164 (M–698) May 18, 1988 & JP 62 22738 Kawasaki Steel Corp. Dec. 8, 1987 Abstract.

Patent Abstracts of Japan vol. 15, No. 244 (M–1127) Jun. 24, 1991 & JP 03 077704 Kawasaki Steel Corp. Apr. 3, 1991 Abstract.

Patent Abstracts of Japan, vol. 11, No. 266 (M–620) Aug. 28, 1987 & JP–A–62 068646 (Ishikawajima) Mar. 28, 1987 abstract.

Patent Abstracts of Japan, vol. 14, No. 217 (M–0970) May 8, 1990 & JP–A–02 052103 (Ishikawajima) Feb. 21, 1990 Abstract.

Steel Times—Incorporation Iron and Steel, vol. 220, No. 12 Dec. 1, 1992, pp. 552–553, Operation of SMI's Slab Sizing Press.

Patent Abstracts of Japan, vol. 14, No. 224, (M–0972) May 11 1990 & JP–A–02 055607 (Ishikawajia) Feb. 24, 1990 abstract.

(List continued on next page.)

*Primary Examiner*—David Jones
*Attorney, Agent, or Firm*—Antonelli, Terry, Stout & Kraus, LLP

[57] ABSTRACT

Method and device for the lateral compacting of slabs, which is employed in a rolling line at least upstream of the finishing rolling mill stands as an alternative to, or in cooperation with, rolling mill stands with vertical rolls, employing two counter-opposed compacting dies (11) supported by relative die-holder bodies (13) and associated with relative lateral edges of the slab (12) being rolled, each compacting die (11) cooperating with the relative actuation system comprising a crankshaft (15) and one element having the function of a connecting rod (18) positioned with its axis (30) on the same plane as, and perpendicular to, the axis of feed of the slab (12) and having one of its ends rotatably associated with the crankshaft (15) and its other end rotatably associated with the relative die-holder body (13), including two connecting rod elements associated with each crankshaft and with each die-holder body, at least one of the two connecting rod elements varying its length during each working cycle, said variation occurring at least during the return travel of the die-holder body.

15 Claims, 3 Drawing Sheet

OTHER PUBLICATIONS

Patent Abstracts of Japan vol. 94 No. 011, & JP–A–02 304611 (Sumitomo Metal Ind Ltd) Nov. 1, 1994—abstract.

Patent Abstracts of Japan, vol. 16, No. 212 (M–1250) May 19, 1992 & JP–A–04 037403 (Ishikawajima) Feb 7, 1992 abstract.

Patent Abstracts of Japan vol. 14 No. 436 (M–1027) Sep. 18, 1990 & JP–A–02 175011 (Ishikawajima) Jul. 6, 1990—Abstract.

Patent Abstracts of Japan vol. 5, No. 47 (M–061) Mar. 28, 1981 & JP–A–56 004304 (Sumitomo Metal) Jan. 17, 1981—abstract.

METHOD FOR THE LATERAL COMPACTING OF SLABS AND RELATIVE DEVICE

BACKGROUND OF THE INVENTION

This invention concerns a method for the lateral compacting of slabs and the relative device.

The device according to the invention is located in a rolling line at least upstream of the finishing rolling mill stands so as to apply an action of compression on the lateral edges of the slab passing through in order to produce a reduction of width thereof and, at the same time, a compaction of the crystalline structure of the slab.

The usual layouts of rolling lines provide for the slab passing through to undergo a succession of passes in rolling mill stands having the axes of their rolls alternately horizontal and vertical so as to achieve progressive reductions of the thickness-width of the slab.

The rolling mill stands having the axis of their rolls vertical are commonly called "vertical edgers".

This alternation of horizontal-vertical passes also causes an effect of progressive compaction of the crystalline structure of the steel with a resulting reduction of the interstitial hollows and therefore an improvement of the superficial and inner quality of the finished product.

However, the compression action achieved by means of the vertical rolls, which carry out this compression by rolling, has been found more and more inadequate for achieving the quality standards which the market now requires.

Moreover, this rolling action has been found ineffective for great reductions of width inasmuch as this process produces only a localised swelling at the edges but has a very limited effect on the material in the body of the slab.

Embodiments have therefore been developed which can be introduced into a rolling line having a substantially continuous cycle and which have the purpose of improving the effectiveness of this lateral compression action and thus the quality levels that can be achieved without thereby affecting the production capacity of the line.

The state of the art has included embodiments which employ pressure systems associated with the lateral edges of the slab passing through.

One of the main purposes of these pressure systems is to achieve considerable reductions of width of the slab, up to 350 mm., in such a way as to increase the range of strip which can be produced, starting from the same one width of the slab.

This result, as we said above, cannot be achieved with the vertical edgers, which swell only the zone next to the edges which then becomes enlarged again in the horizontal rolling mill stands, and therefore the net residual reduction which can be achieved with those edgers is about equal to 20% of that which can be achieved with the press systems.

The economic justification of the press systems is substantially based on the increase of output of the continuous casting machine, which works without any change of format, on the reduction of the range of the variety of the slabs and on the improvement of the yield owing to the reduction of the discards of the leading and trailing end portions.

Press systems have been disclosed both of an alternate start-stop type with feed of the slab in steps and pressure on the slab when halted, and also of a continuous "flying" type, whereby the slab continues to move forward even during the pressure step.

The embodiments of the state of the art, however, have been found unsatisfactory in terms of complexity of the structure, complexity of the working cycle, difficulty of gauging to obtain the desired result in terms of reduction of width, poor versatility and worse adaptation to the variations of the conditions of the rolling cycle and owing to still other problems.

Moreover, the embodiments of the state of the art entail a great vertical bulk, which creates also great problems when it is necessary to perform maintenance and/or replacement of parts.

Furthermore, in the embodiments of the state of the art the adjustment of the reduction of width of the slab is achieved either by displacing transversely the whole structure which contains the crankshafts or by interposing auxiliary adjustment elements between the connecting rod coupled to the crankshaft and the die-holder body.

It is obvious that this adjustment entails halting the line, long times and great difficulties of corrective work, the use of labour, additional costs, poor versatility, poor accuracy of adaptation and still other problems.

JP-A-6-304611 discloses a press with crankshafts with the axis on the same plane but at a right angle to the plane of positioning of the slab to be worked.

This document teaches to include a single connecting rod element conformed as a cylinder-piston.

SUMMARY OF THE INVENTION

The present applicants have designed, tested and embodied this invention to overcome the shortcomings of the state of the art and to achieve further advantages.

The purpose of the invention is to provide a lateral compaction device with simultaneous and consequent reduction of width in a rolling line for slabs, whereby the device has modest weights and bulk and possesses high characteristics of reliability, simplicity of construction and functioning, ease of corrective work, flexibility and versatility;

One or more devices according to the invention are introduced along the rolling line at least upstream of the finishing rolling mill stands and can be positioned as an alternative to, or in cooperation with, the usual rolling mill stands with vertical rolls.

The invention can be employed both with an alternating actuation system with feed of the slab in steps and with pressure applied with the slab halted, and with a continuous actuation system with pressure applied to the slab in movement.

The compaction device according to the invention comprises two elements which have the function of compacting dyes and which act on the relative lateral edges of the slab passing through.

According to the invention, the system controlling the actuation of each single compacting die comprises a connecting rod-crank mechanism in which the crank consists of a crankshaft associated with two connecting rod elements which act on the same compacting die.

In the device according to the invention the crankshaft is arranged with its axis horizontal and parallel to the direction of feed of the slab, while the connecting rod elements lie on the plane of positioning of the slab with their axis substantially at a right angle to the slab.

This embodiment entails a great reduction of the vertical bulk of the device as a whole.

Every connecting rod element is suitable to oscillate on a vertical plane and has its first end rotatably coupled to the eccentric of the crankshaft and its second end rotatably coupled, according to a horizontal axis, to the body on which are fitted the compacting dies.

According to the invention at least one of the two connecting rod elements associated with a crankshaft consists of at least two parts coupled together and able to be displaced axially from each other, whereby the first part has its free end rotatably associated with the eccentric of the crankshaft, while the second part has its free end rotatably associated with the die-holder body.

This embodiment makes possible the adjustment of the length of the connecting rod element as necessary and enables the actuation means to be kept stationary without using articulated adapters or other analogous means;

This situation leads to a great reduction of bulk, weight and costs and also enables the device itself to be adapted for the production of various widths of the slab in a very quick and simplified manner.

It also enables a very accurate level of adjustment to be achieved.

The variation of the length of the connecting rod enables the value of reduction of the width of the slab to be adjusted as desired without altering any other part of the device.

According to the invention the connecting rod element cooperates with a means performing controlled variation of the length of the connecting rod, this means being able to be operated by an external drive and being associated with means for measurement and control of the length of the connecting rod and also with means for take-up of the plays.

In one embodiment of the invention the first part of the connecting rod element includes an outwardly threaded terminal stem, whereas the second part of the connecting rod element includes a mating and inwardly threaded ring nut element.

According to this embodiment the actuation for adjustment of the ring nut element so as to vary the length of the connecting rod element can be obtained by using worm screw means associated with motor means providing controlled actuation.

According to another embodiment a system for reciprocal actuation with a fluid is provided between the two parts of the connecting rod element by machining in one of the two parts a cavity having the function of a cylinder and in the other part a non-rotatable end having the function of a piston.

The introduction and expulsion of a hydraulic fluid into and out of this cavity entails the relative movement of the two parts in relation to each other and therefore the adjustment of the length of the connecting rod element.

The ability to vary the length of at least one connecting rod, where there are two connecting rod-crank systems associated with the same die-holder body, makes possible a controlled axial displacement of one of these systems in relation to the other even during the working cycle.

In particular, during the return travel of the die-holder body, the connecting rod-crank positioned upstream in relation to the feed of the slab can be elongated by a determined value as compared to the other connecting rod-crank by actuating the screw system in the first embodiment described or by introducing fluid into the hollow of the cylinder in the second embodiment described.

This situation enables the geometry of the trajectory performed by the die to be modified, particularly in its rear segment, in relation to the actuation imparted by the crankshaft, thus obtaining an action of upsetting at least the rear part of the edge of the slab affected by the pressure step and pre-arranging that edge for the pressure in the next step.

According to a variant, so as to apply the pressure on the moving slab, the first part of the connecting rod element rotatably coupled to the eccentric of the crankshaft consists of two elements which are rotatably coupled together by an articulated joint.

The second part too of the connecting rod coupled to the die-holder body consists of two elements coupled together by an articulated joint.

The respective two elements which form respectively the first and the second parts of the connecting rod element are coupled according to respective axes, which are parallel to each other and perpendicular to the axis of the crankshaft and to the axis of the connecting rod element.

The die-holder body can thus be displaced in a direction parallel to the feed of the slab, thus making possible the application of the pressure even when the slab is moving.

The longitudinal movement of the die-holder body can be controlled with a suitable hydraulic or mechanical control.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figures 1, 3:
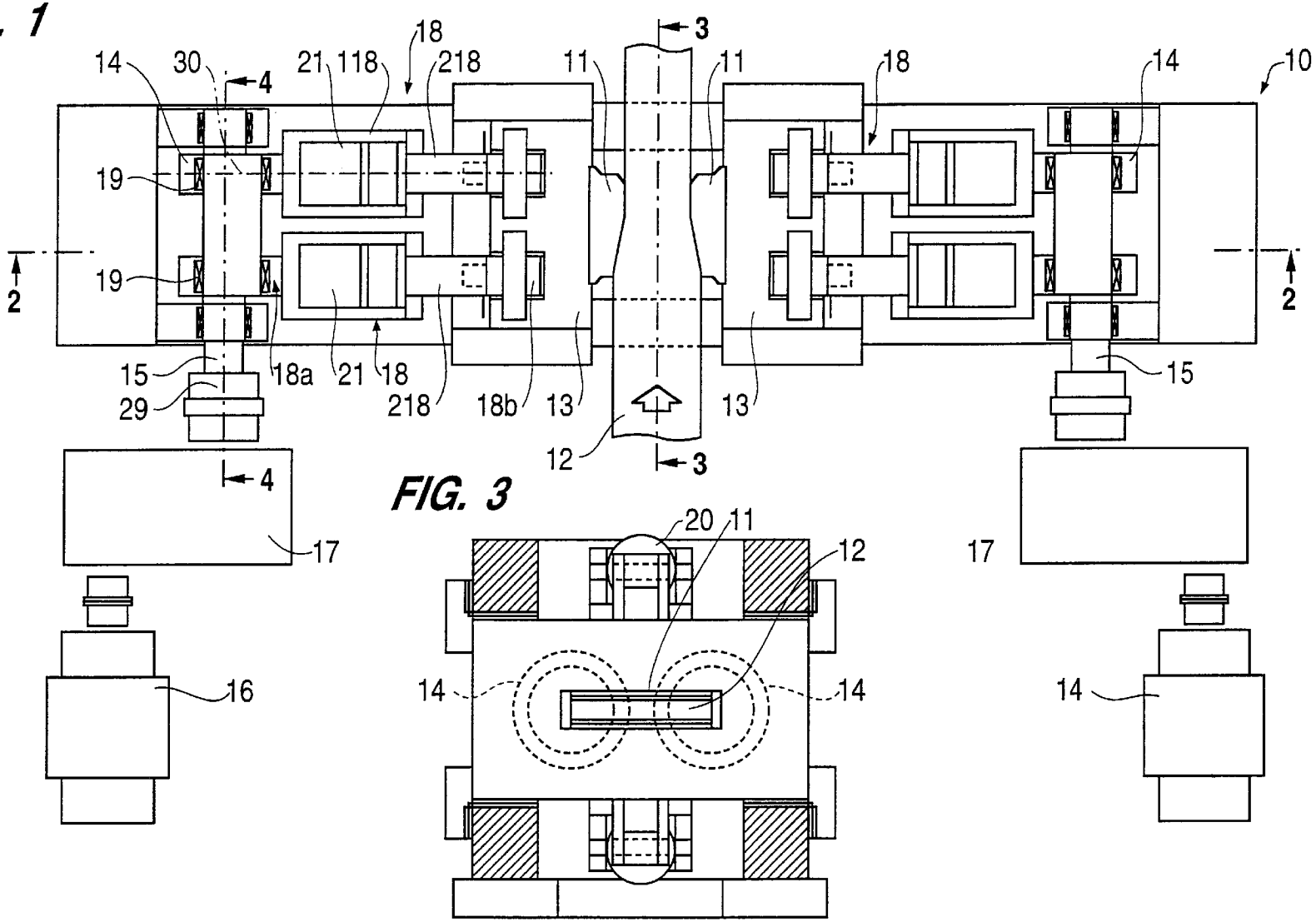
FIG. 1 is a view from above of the lateral compaction device according to the invention.
FIG. 3 shows a cross-section along the line A—A of FIG. 1.

A lateral compacting device 10 shown in the attached figures comprises two elements having the function of compacting dies 11 acting on the opposed lateral edges of a slab 12.

These compacting dies 11 apply an action of lateral compression with an alternating or continuous functioning, which causes a reduction of width of the slab 12 passing through (FIG. 1) and also a compaction of the crystalline structure of the steel.

The compacting dies 11 are borne on relative die-holder bodies 13, which are displaced with a to-and-fro movement in the direction of the edges of the slab 12 by a relative drive system of a connecting rod-crank type on each of the two sides of the slab 12.

In this case there are two connecting rod-crank systems for each single compacting die 11.

The crank of the drive system consists in this case of an eccentric 14 associated with a crankshaft 15, which gets its motion from a relative motor 16 associated with a reduction gear unit 17.

Figure 5:
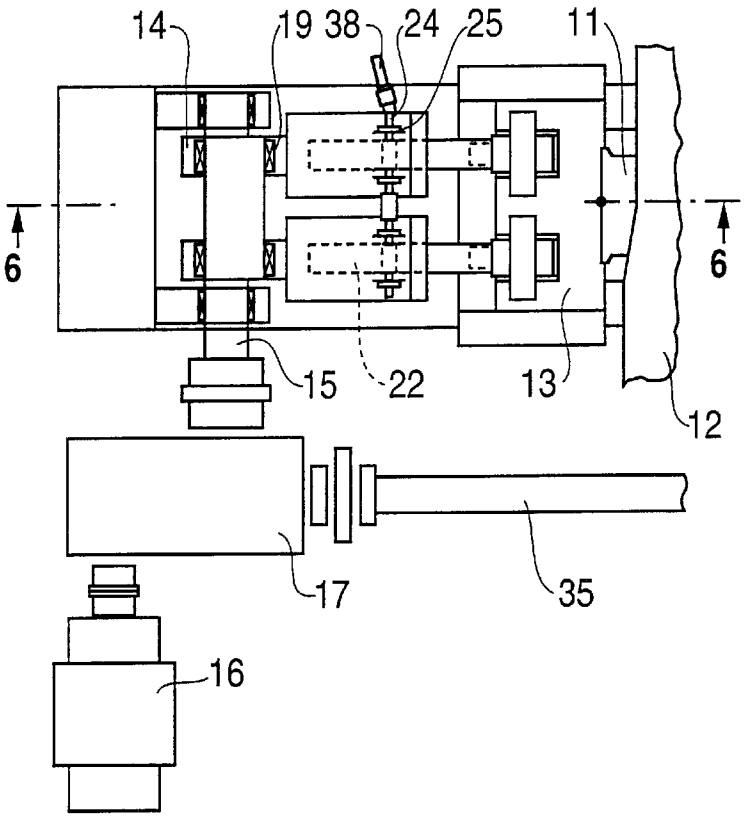
FIG. 5 shows part of a variant of FIG. 1.

According to the variant shown partly in FIG. 5 there is one motor 16 for both the connecting rod-crank systems, and a mechanical connection, which in this case is a partly shown transmission shaft 35, is included between the two connecting rod-crank systems.

The crankshaft 15 is positioned with its axis 29 lying on a horizontal plane parallel to the plane of positioning of the slab 12.

The actuation of the crankshaft 15 sets in rotation the eccentric 14, which rotates on bearings 19 and in this way imparts the to and fro alternating movement to the connecting rod 18.

The connecting rod 18 is rotatably coupled at its first end 18*a* to the eccentric 14, while its other end 18*b* is rotatably coupled according to a horizontal axis to the die-holder body 13.

In this example the connecting rod 18 is embodied with two parts axially displaceable in a controlled manner in relation to each other so as to alter the position of the compacting dies 11 in relation to the lateral edges of the slab 12 by lengthening or shortening the connecting rod 18 itself.

This alteration of the length of the connecting rod 18 can be carried out to alter very quickly and simply the range of reductions of the width of the slabs 12 which can be achieved.

This controlled variation of the length of the connecting rod 18 can also be carried out during the working cycle and, in particular, during the return travel of the die-holder body 13.

This situation enables the geometry of the trajectory imparted by the crankshaft 15 to the die-holder body 13 to be changed.

In particular, by lengthening by a determined value the connecting rod positioned upstream in relation to the feed of the slab 12 (see the arrow 36 in FIG. 7) during the return travel of the die-holder body 13, a further rotation is caused of the rear part of the compacting die 11 towards the edge of the slab 12 (see the arrow 37); this causes an action of upsetting of that edge, thus improving the effectiveness of the pressing action and pre-arranging that part of the edge for the pressing in the next cycle.

In this example, pistons 20 which have the task of taking up the plays are included and are arranged symmetrically above and below the relative die-holder body 13.

Figure 2:
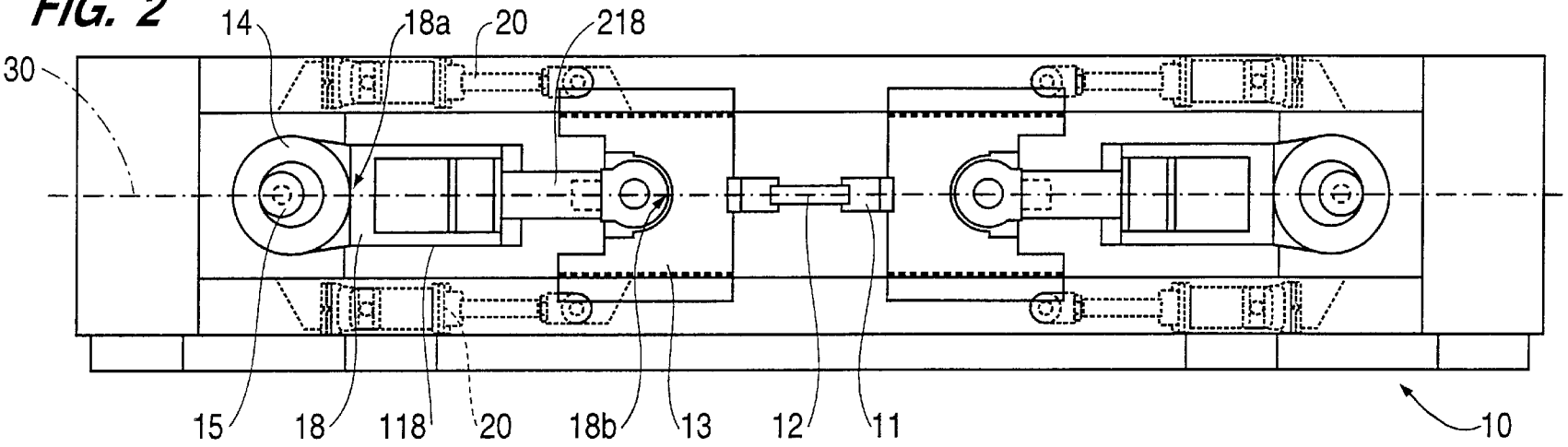
FIG. 2 shows a section along the line C—C of FIG. 1.
Figure 4:
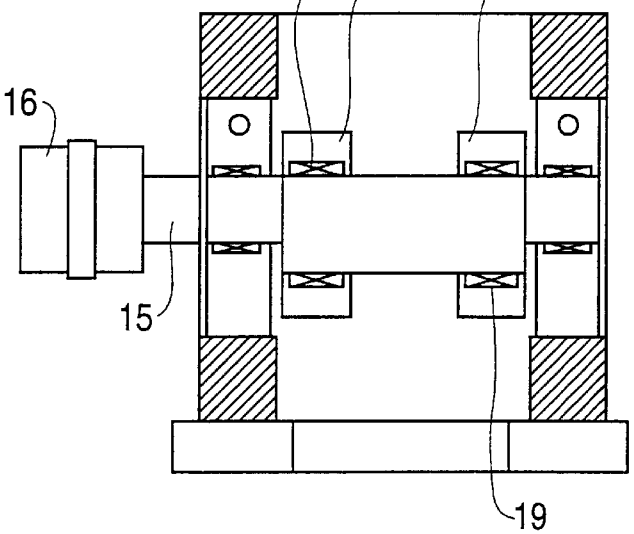
FIG. 4 shows a cross-section along the line B—B of FIG. 1.

In the embodiment shown in FIGS. 1 and 2 the connecting rod 18 consists of a first part 118, which acts as a jacket defining an inner chamber 21 that can be filled with a suitable hydraulic actuation fluid; this first part 118 is rotatably coupled to the relative eccentric 14.

Into that inner chamber 21 there extends an end of a second part 218 of the connecting rod 18, this end having the function of a piston.

When a liquid is immitted into or expelled from the inner chamber 21, the second part 218 of the connecting rod 18 is displaced respectively towards or away from the relative edge of the slab 12, depending on the specific requirements.

Figure 6:
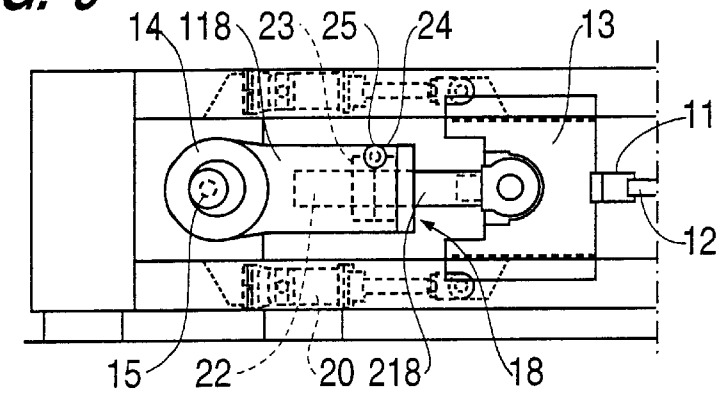
FIG. 6 shows a section along the line D—D of FIG. 5.

In the case of FIGS. 5 and 6 the first part 118 of the connecting rod 18 includes an outwardly threaded stem 22, while the second part 218 is associated with a threaded ring nut 23.

Actuation of the threaded ring nut 23 to bring nearer or farther the second part 218 to or from the relative edge of the slab 12 is achieved in this case by means of a worm screw 24 associated with a helicoidal ring nut 25. The worm screw 24 is associated in this example with powered actuation means 38.

In the event of hydraulic actuation as shown in FIGS. 1 and 2 and in the case of mechanical screw actuation as shown in FIG. 5 and 6 the adjustment can be carried out by means of a remote-control system governed by control and measurement systems including sensors, for instance.

As mentioned above, this enables corrective action to be taken during the cycle of performance of the pressing so as to obtain differentiated elongation of the connecting rods 18 during the return travel, thus achieving this alteration of the trajectory travelled by the compacting die 11.

Figure 8:
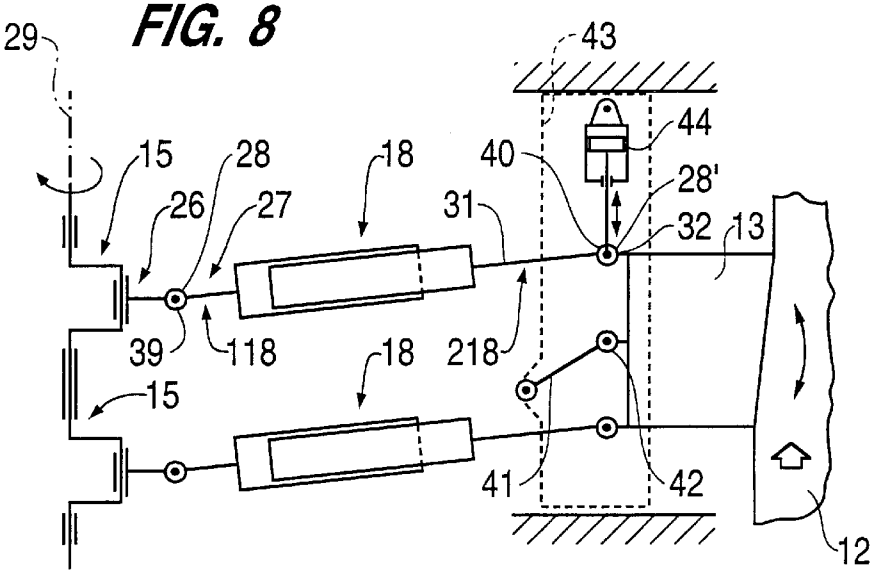
FIG. 8 is a diagram of a further embodiment according to the invention.

According to a variant (FIG. 8), which is used in the event of employment of the device 10 according to the "flying" system with pressure against the slab 12 while in movement, the first part 118 of the connecting rod 18 is embodied with two respective elements 26 and 27, which are coupled together by means of an articulated spherical joint 39 according to an axis 28 perpendicular both to the axis 29 of the crankshaft 15 and to the axis 30 of the connecting rod 18.

The second part 218 of the connecting rod 18 is in turn embodied with two respective elements 31, 32, which are coupled together by means of an articulated spherical joint 40 according to an axis 28' parallel to the axis 28.

The die-holder body 13 firmly associated with the second part 218, and in particular with the second element 32 of that second part 218, can thus be moved in a direction parallel to the axis of feed of the slab 12 and can therefore follow this feed during the step of pressing of the compacting dies 11 against the lateral edges of the slab 12.

According to this embodiment the die-holder body 13 is firmly associated with a slider 43 by means of a connection which includes a connecting rod system 41 with an articulated spherical joint 42.

An actuator 44, which is generally electrical or hydraulic, is secured to the slider 43 and is suitable to control the movement of the die-holder body 13 in the direction of feed of the slab 12.

The inclusion of the slider 43 enables the actuator 44 to be brought very close to the die-holder body 13, thus reducing the travel, size and therefore the weights and overall bulk of the actuator 44.

Figure 7:
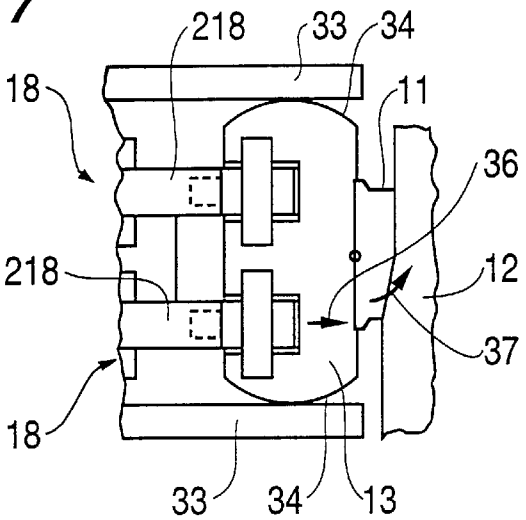
FIG. 7 shows part of a variant of FIG. 5.

The variant shown in FIG. 7 illustrates the case in which the longitudinal position of the die-holder body 13 in the step of differentiated elongation of the connecting rod 18 so as to obtain the oscillatory movement of the compacting die 11 is defined not by the actuator 44 but by lateral guides 33, which provide a flat/cylindrical coupling with the sidewalls 34, formed as an arc of a circle, of the die-holder body 13.

It is obviously possible that the lateral guides 33 are shaped as an arc of a circle and that the sidewalls 34 of the die-holder body 13 are straight.

We claim:

1. Method for the lateral compacting of slabs, which is employed in a rolling line at least upstream of the finishing rolling mill stands as an alternative to, or in cooperation with, rolling mill stands with vertical rolls, the method comprising: feeding a slab through the rolling line along an axis of feed, laterally compacting the slab between two counterposed compacting dies supported by relative die-holder bodies associated with relative lateral edges of the slab, each compacting die cooperating with a relative actuation system comprising a crankshaft and a pair of connecting rod elements positioned with their axes on the same plane as, and perpendicular to, the axis of feed of the slab and having one end of each connecting rod element rotatably associated with the relative die-holder body, and varying a length of at least one of the two connecting rod elements at least during return travel of the die-holder body during each working cycle.

2. Device for the lateral compacting of slabs, which is employed in a rolling line at least upstream of the finishing rolling mill stands as an alternative to, or in cooperation with, rolling mill stands with vertical rolls, the device comprising: two counter-opposed compacting dies supported by relative die-holder bodies and associated with relative lateral edges of the slab being rolled, each compacting die cooperating with a relative actuation system comprising a crankshaft and a pair of connecting rod elements positioned with their axes on the same plane as, and perpendicular to, an axis of feed of the slab and having one end of each connecting rod element rotatably associated with the crankshaft and another end rotatably associated with the relative die-holder body, wherein the crankshaft is positioned with its axis lying on a plane parallel to a plane of feed of the slab, and wherein at lease one connecting rod element of the two connecting rod elements associated with a crankshaft comprises at least two parts coupled together and axially displaceable in relation to each other in a controlled manner.

3. Device as in claim 2, in which the connecting rod element comprising at least two parts is at least the connecting rod element placed upstream with respect to the feed of the slab.

4. Device as in claim 2, in which the connecting rod element comprising at least two parts is at least the connecting rod element placed downstream with respect to the feed of the slab.

5. Device as in claim 2, in which each of the connecting rod elements comprises two parts coupled together and axially displaceable in relation to each other in a controlled manner.

6. Device as in claim 2, in which the at least two parts of the connecting rod element can be displaced in relation to each other by a mechanical screw-type actuation associated with an external drive.

7. Device as in claim 2, in which one of the at least two parts of the connecting rod element includes in a substantially terminal position an outwardly threaded stem, whereas the other of the at least two parts includes in a substantially terminal position a mating threaded element.

8. Device as in claim 7, in which the threaded element is associated with a worm screw connected to powered actuation means.

9. Device as in claim 2, in which the at least two parts of the connecting rod element can be reciprocally displaced by means of hydraulic actuation.

10. Device as in claim 9, in which one of the at least two parts of the connecting rod element includes substantially at its ends a jacket defining an inner chamber containing hydraulic actuation fluid, whereas the other of the at least two parts has a non-rotatable end positioned within the inner chamber and having the function of a piston.

11. Device as in claim 2, in which the die-holder body can be displaced in a direction parallel to the direction of feed of the slab, first part of the at least two parts of the connecting rod element comprising two elements coupled together by a relative articulated spherical joint, and a second part of the at least two parts of the connecting rod element comprising two elements coupled together by a relative articulated spherical joint.

12. Device as in claim 2 inclusive, in which the length of at least one of the connecting rod elements associated with the same compacting die can be adjusted separately and in a manner which can be differentiated from the length of another the connecting rod elements.

13. Device as in claim 2 in which lateral sidewalls of the die-holder body cooperate with lateral guides providing a flat/spherical coupling.

14. Device as in claim 2 inclusive, in which the die-holder body cooperates with an actuator providing longitudinal displacement in a direction substantially parallel to the feed of the slab.

15. Device as in claim 14, in which the actuator is secured to a slider solidly associated with the die-holder body by a connecting rod anchorage element.

* * * * *